US009061313B1

(12) United States Patent
Williams et al.

(10) Patent No.: US 9,061,313 B1
(45) Date of Patent: Jun. 23, 2015

(54) APPLICATION OF SUBSTANCE TO PROTRUSION

(71) Applicants: Craig A. Williams, Maumee, OH (US); Charles J. Barnhart, Toledo, OH (US)

(72) Inventors: Craig A. Williams, Maumee, OH (US); Charles J. Barnhart, Toledo, OH (US)

(73) Assignee: Designetics, Inc., Holland, OH (US)

( * ) Notice: Subject to any disclaimer, the term of this patent is extended or adjusted under 35 U.S.C. 154(b) by 43 days.

(21) Appl. No.: 13/663,113

(22) Filed: Oct. 29, 2012

Related U.S. Application Data

(60) Provisional application No. 61/552,970, filed on Oct. 28, 2011.

(51) Int. Cl.

| | |
|---|---|
| ***A46B 11/00*** | (2006.01) |
| ***B05C 11/00*** | (2006.01) |
| ***B05C 1/02*** | (2006.01) |
| ***B05C 1/06*** | (2006.01) |

(52) U.S. Cl.
CPC .... *B05C 1/02* (2013.01); *B05C 1/06* (2013.01)

(58) Field of Classification Search
CPC ..... B05C 1/027; B05C 1/02; B05C 1/06; B05C 1/022
USPC ..... 401/11, 203, 282; 118/264, 267–270, 118/266, DIG. 11; 15/244.1, 244.4
See application file for complete search history.

(56) References Cited

U.S. PATENT DOCUMENTS

| | | | | |
|---|---|---|---|---|
| 4,440,207 | A * | 4/1984 | Genatempo et al. | 150/154 |
| 5,743,359 | A * | 4/1998 | Parnell | 184/102 |
| 5,932,083 | A | 8/1999 | Stoffer et al. | |
| 6,547,880 | B1 * | 4/2003 | Krueger et al. | 118/264 |
| 6,818,116 | B2 | 11/2004 | Stoffer et al. | |
| 7,048,807 | B2 | 5/2006 | Stoffer et al. | |
| 7,232,273 | B2 * | 6/2007 | Nealon et al. | 401/266 |
| 7,241,371 | B2 | 7/2007 | Stoffer et al. | |
| 7,452,427 | B2 | 11/2008 | Morris | |
| 7,601,425 | B2 | 10/2009 | Stoffer et al. | |
| 7,759,419 | B2 | 7/2010 | Stoffer et al. | |
| 8,770,881 | B2 * | 7/2014 | Dam | 401/11 |
| 2004/0249023 | A1 | 12/2004 | Stoffer et al. | |
| 2009/0065101 | A1 | 3/2009 | Morris | |
| 2011/0300390 | A1 | 12/2011 | Morris | |
| 2012/0291700 | A1 * | 11/2012 | Thommes | 118/270 |

* cited by examiner

*Primary Examiner* — Jennifer C Chiang
(74) *Attorney, Agent, or Firm* — Donald K. Wedding

(57) ABSTRACT

A fluid applicator for applying a fluid to a surface protrusion. In one embodiment, an anticorrosion substance is applied to a structural fastener.

16 Claims, 6 Drawing Sheets

APPLICATION OF SUBSTANCE TO PROTRUSION

RELATED APPLICATION

This application claims priority under 35 U.S.C. 119(e) of Provisional Application 61/552,970 filed Oct. 28, 2011, incorporated herein by reference.

INTRODUCTION

This invention relates to fluid applicators. Examples of fluid applicators are disclosed in U.S. Pat. No. 5,131,349 (Keller et al.), U.S. Pat. No. 5,743,959 (Ash et al.), U.S. Pat. No. 6,547,880 (Krueger et al.), and U.S. Design Pat. No. 480,959 (DeWood), 480,632 (Williams et al.), 468,633 (DeWood), all incorporated herein by reference.

In accordance with this invention, there is provided a fluid applicator with a hollow body or base containing a porous material with an aperture formed to a predetermined depth and diameter for uniformly applying a selected fluid to a surface protrusion such as a structural fastener.

In one embodiment, an anticorrosion substance or material is controllably and uniformly applied to structural fasteners such as used in the assembly of an aircraft body.

In such embodiment, there is provided apparatus and method for applying an anticorrosion substance to structural fasteners by positioning a female aperture of porous material over a male protrusion or fastener and controllably flowing the anticorrosion substance to the porous material so as to uniformly coat the fastener with the substance.

In another embodiment, the anticorrosion substance is a fluid, typically an anticorrosion liquid such as a corrosion resistant conversion composition as disclosed in U.S. Pat. No. 7,452,427 (Morris) and U.S. Patent Application Publication 2009/0065101 (Morris), both incorporated herein by reference.

BACKGROUND

The fluid applicator is of any suitable geometric shape and comprises a hollow polymeric body or base with a porous material inside the hollow body. The applicator may contain additional structure such as a neck or nozzle for the flow of fluid from a source to the hollow body.

The body or base of the fluid applicator is typically made of a polymeric substance, for example a thermoplastic such as high-density polyethylene or high strength polypropylene including composites or blends thereof. In one preferred embodiment, there is used high-density polyethylene. However, there may be used other polymer materials such as polyvinyl chloride, polycarbonate, and polyamides. Composites or blends may be used, particularly composites or blends of high-density polyethylene and high strength polypropylene. The applicator body may be made of a wide range of other materials including rubber, ceramic, glass, glass ceramic, or sintered powdered metal.

Porous Material

The fluid applicator contains a porous material within the body. The porous material is an organic (natural) material or a synthetic material with a wicking property so that the porous material readily absorbs a fluid such as a liquid for transfer to the protrusion such as a fastener. Wicking typically comprises the absorption of the liquid into the porous material by capillary action. The absorbed liquid is dispensed by the porous material and deposited on the protrusion.

The porous material is typically made from one or more wicking materials that comprise a matrix of felted, woven, or non-woven fibers or filaments. The porous material may comprise a single thickness of the selected material or multiple plies or layers depending upon the required flow properties, flow characteristics, flow rates, and other factors that may affect the dispensing of the liquid.

Depending upon the application, the porous material is used in any geometric form or shape suitable for the dispensing of the fluid to the protrusion. The criteria for selecting the porous material include the compatibility of the porous material with the fluid and/or solids to be dispensed including the chemical composition and flow properties such as viscosity of the fluid and/or solids. The properties and characteristics of the selected porous material including chemical composition, thickness, geometry, and porosity are determined by the properties and characteristics of the fluid to be flowed and dispensed, including any solids carried in the fluid. The selected porous material must be chemically resistant or inert to the fluid.

The internal construction of the porous material may comprise a single or multiple plies, homogeneous or non-homogeneous composition(s) and may comprise a composite and/or blend of several materials. The porous material is selected to provide the desired flow or percolation rate for the fluid and/or solids.

The flow or percolation rate may be determined for a liquid by the capillary action of the porous material and by the gravity or pressure feed of the liquid to the porous material. The properties that affect liquid flow through the porous material include liquid viscosity, liquid temperature, liquid chemical composition, reactivity of the liquid with the porous material, the liquid holding capacity of the porous material, and the geometric form or shape of the porous material. The porous material may be in any suitable geometric form or shape that absorbs the liquid and deposits it on the protrusion. In one embodiment, the porous material is in the shape of a resilient pad.

The composition of contemplated porous materials include organic or natural substances with a suitable wicking property such as cotton, natural sponge, cloth, wool, plant fiber, bristles, hemp, animal fur, human hair, and animal hair. Animal hair includes horse hair, camel hair, and goat hair. In one specific embodiment, there is used goat hair such as mohair.

The porous materials also include synthetic substances such as synthetic sponge, glass fibers, metal fibers, and polymeric substances. Examples of polymeric substances include polyamides and polyesters. The polyamides include nylon, nylon-6, and nylon-6,6. In one embodiment there is used Melamine®. The polyesters include condensation polymers that contain an ester functional group in the primary or main chain such as polycarbonate and polyethylene terephthalate (PET). In one specific embodiment, there is used a felt or porous material made from polyester such as PET. In another embodiment, there is used a composite of polyester such as PET and a polyamide such as nylon.

The pore size of the porous material will vary depending upon the composition of the liquid that is to be dispensed. The term pore size is used to mean the size of the interstices of the material. The mean pore size can be determined by any standard test for determining porosity and pore size distribution. For example, mercury porosimetry is one method used to determine porosity and pore size.

The porous material may comprise a wide range of densities and specific gravities. In one embodiment, the density of the selected porous wicking material ranges from about 0.003 to about 0.009 ounces per cubic inch. The thickness of the porous material may range from about 90 mils to about 1.5 inches or more.

In another embodiment, there may be used a brush instead of a porous material which is positioned within or attached to the fluid applicator base. The brush serves to apply a fluid such as a liquid to an object. The brush may be made of an organic or natural material such as human hair or animal hair. Animal hair includes horse hair, camel hair, and goat hair. The brush may be made of other organic or natural materials similar to those used for the porous material including soft or stiff cotton, sponge, cloth, wool, plant fibers, bristles, and hemp. Animal fur and feathers are also contemplated. The brush may also be made of synthetic materials such as such as synthetic sponge, glass fibers, metal fibers and polymeric substances such as the polyamides and polyesters. The polyamides include nylon, nylon-6, and nylon-6,6. The polyesters include condensation polymers that contain an ester functional group in the primary or main chain such as polycarbonate and polyethylene terephthalate (PET).

In some applications, a fluid passage through-hole may be formed through the porous material or brush so as to enhance the flow of the fluid to one or more surfaces of the fastener. Depending upon the thickness of the porous material and the viscosity of the particular fluid to be flowed, fluid flow may be enhanced especially through thick porous material by forming a fluid passage hole through the porous material. This through-hole may be made by any suitable means such as a punch, needle, cutter, or the like so as to punch, pierce, cut or otherwise mechanically form the hole. The diameter of the porous material through-hole ranges from about 10 mils to about 150 mils, typically about 15 mils to about 75 mils. A mil is defined as 0.001 inch. The depth or thickness of the through-hole typically ranges from about 90 mils to about 1.5 inches.

The fluid applicator device may dispense a wide variety of fluids for preparing or treating an object, such as a protrusion on the surface or surfaces of the object. Such preparation or treatment include coating, cleaning, etching, and surface enhancing such as the application of adhesives, glues, fillers, pigments, corrosion resistant substances or the like. Multiple surfaces can be simultaneously treated.

Fluids

Fluid(s) as used herein includes liquid(s) or gas(es). Examples of liquids include silane, amino silane, urethane, isocyanates, diisocyanate, polyisocyanate, xylene, p-xylene, ketones such as methyl isobutyl ketone (MIBK) and methyl ethyl ketone (MEK), acids such as acetic acid (vinegar), boric acid, nitric acid (for etching) and vehicles and/or solvents such as ethers, acetone, glycols, alcohols including methyl alcohol and isopropyl alcohol, and benzene including alkyl benzenes such as methyl benzene (toluene) ethyl benzene, and propyl benzene. Toluene based fluids are contemplated, such as Chemlok® and lubricants. Chemlok® is a family of rubber to metal adhesives marketed by Lord Worldwide, Cary, N.C. A number of other liquids including vehicles and solvents may be used in addition to those listed herein. The selected liquid(s) may comprise a mixture of those listed above and/or other liquids not listed.

The liquid may contain selected solid particulates such as carbon black, which is suitable for ultraviolet (UV) screening and protection of the window seals in automobiles. The selected solid particulates may also comprise inorganic and organic pigments, fillers, dyes, and phosphors for selected applications comprising quality control and detection including quantitative and quality analyses.

Corrosion resistant conversion coatings may be applied. Such coatings are disclosed in U.S. Pat. No. 5,932,083 (Stoffer et al.), U.S. Pat. No. 6,818,116 (Stoffer et al.), U.S. Pat. No. 7,048,807 (Stoffer et al.), U.S. Pat. No. 7,241,371 (Stoffer et al.), U.S. Pat. No. 7,452,427 (Morris), U.S. Pat. No. 7,601,425 (Stoffer et al.), U.S. Pat. No. 7,759,419 (Stoffer et al.), and U.S Patent Application Publication Nos. 2004/0249023 (Stoffer et al.), 2009/0065101 (Morris), 2011/0300390 (Morris), all incorporated herein by reference.

Examples of inorganic solids or particulates include inorganic compounds of metals and/or metalloids including mixtures or combinations thereof. The inorganic compounds include, not by way of limitation, oxides, carbides, nitrides, nitrates, silicates, aluminates, sulfides, sulfates, phosphates, borosilicates, borides, and/or borates.

The metals and/or metalloids include, not by way of limitation, one or more selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Specific inorganic compounds include titanium oxide(s), zinc oxide(s), magnesium oxide(s), aluminum oxide(s), zirconium oxide(s), silicon oxide(s), and silicon carbide(s) such as $TiO_2$, ZnO, MgO, $Al_2O_3$, $ZrO_2$, $SiO_2$, and/or SiC.

Other particulate solids include particles of glass, ceramic, glass ceramic, refractory, fused silica, quartz, or like amorphous and/or crystalline materials including mixtures of such. There may also be used particles of plastics, rubber, metals, and inorganic or organic luminescent materials such as phosphors.

Examples of organic particulates include polymeric substances such as acrylic, polyurethane, or epoxy synthetic resins dissolved in a suitable solvent. Such organic particulates may comprise one or more organic compounds, monomers, dimers, trimers, polymers, copolymers, or like organic or polymeric materials including organic dyes, dopants, and organic luminescent materials such as phosphors.

In one embodiment, the fluid is a gas such as air, steam, nitrogen, oxygen, carbon dioxide, rare gas or the like with finely divided solids or particulates suspended in the gas stream. The rare gas is selected from neon, argon, xenon, krypton, and helium including mixture thereof. The solids or particulates are as defined above.

The particulates are incorporated into the fluid by any suitable means such as a ball mill, fluid bed or a spray nozzle so as to provide a solution, dispersion, or suspension of the particulates in the fluid.

A peristaltic pump may be used to supply fluid to the fluid applicator. A peristaltic pump is a positive displacement pump also known as a dispense head roller drive. The fluid to be pumped is typically contained within a flexible tube fitted inside a casing. A rotor with cams (rollers, shoes, wipers) attached to the external surface of the casing compresses the flexible tub. As the rotor turns, that portion of the tube under compression closes or occludes thereby forcing the fluid to flow through the tube. As the tube opens to its natural uncompressed state after the passing of the cam, fluid flow is induced to the pump. Both circular and linear peristaltic pumps are contemplated.

The fluid applicator is generally used with low viscosity fluids typically about 200 centipoises (cps) or less. If the fluid has a viscosity above 200 cps, it may not be feasible to use a peristaltic pump.

The fluid applicator may be connected to a source of fluid by means of a flexible hose, tube, tubing, conduit, and so forth. The flexible hose or tube may be made of any suitable material such as plastic, rubber, or glass reinforced. Flexible plastic materials, including polymeric materials, such as polyvinyl chloride, polyethylene, polypropylene, and so forth are contemplated. The material is selected to be chemically compatible and resistant to the fluid flowing through the tube.

Anticorrosion Application

In one embodiment, the fluid applicator applies an anticorrosion substance to an object such as a structural fastener. Corrosion is the disintegration of an engineered material into its constituent atoms due to chemical reactions with its surroundings. In the most common use of the word, this means electrochemical oxidation of metals in reaction with an oxidant such as oxygen. Formation of an oxide of iron due to oxidation of the iron atoms in solid solution is a well-known example of electrochemical corrosion, commonly known as rusting. This type of damage typically produces oxide(s) and/or salt(s) of the original metal. Corrosion can also occur in materials other than metals, such as ceramics or polymers, although in this context, the term degradation is more common.

Many structural alloys corrode merely from exposure to moisture in the air, but the process can be strongly affected by exposure to certain substances. Corrosion can be concentrated locally to form a pit or crack, or it can extend across a wide area more or less uniformly corroding the surface. Because corrosion is a diffusion controlled process, it occurs on exposed surfaces. As a result, methods to reduce the activity of the exposed surface, such as passivation and chromate-conversion, can increase a material's corrosion resistance. However, some corrosion mechanisms are less visible and less predictable. The practice of this invention provides a fluid applicator apparatus and method for an improved application of a corrosion resistant substance to the surface of a protrusion such as a structural fastener.

THE INVENTION

In accordance with this invention, there is provided a fluid applicator comprising a hollow body having an elongated axis with opposing ends and an opening or portal at each of the opposing ends, a porous material positioned inside the hollow body along the elongated axis, the porous material containing a female aperture at one end of the hollow body, the aperture being formed to a predetermined depth and predetermined geometric shape so as to allow the porous material to cover a male surface protrusion of a given height or length and of a given geometric shape such that fluid uniformly flows from the porous material to the protrusion.

The aperture depth is typically equal to or greater than the height or length of the protrusion. The geometric shape of the aperture may be the same geometric shape as the protrusion. The depth and geometric shape of the aperture may match the height (or length) and the geometric shape of the protrusion.

The porous material may comprise two or more abutting sections with each section being made of the same porous material of the same composition. Each section may also be made of a porous material of a different composition.

In an embodiment with two abutting sections, the fluid applicator comprises a hollow body having an elongated axis with opposing ends and an opening at each opposing end, a porous material positioned inside the hollow body along the elongated axis, the porous material being two separate sections, with one section of the porous material containing an aperture at one opening of the hollow body, the aperture having a predetermined depth and geometric shape sufficient to cover a surface protrusion such that fluid flowing from the porous material is uniformly applied to the protrusion.

In one application, the protrusion is a structural fastener and the fluid is a corrosion resistant conversion composition. The fastener is covered with a porous material and the anticorrosion substance is controllable flowed to the porous material so as to uniformly coat the fastener with the substance.

DETAILED DESCRIPTION OF THE DRAWINGS

Figure 1:
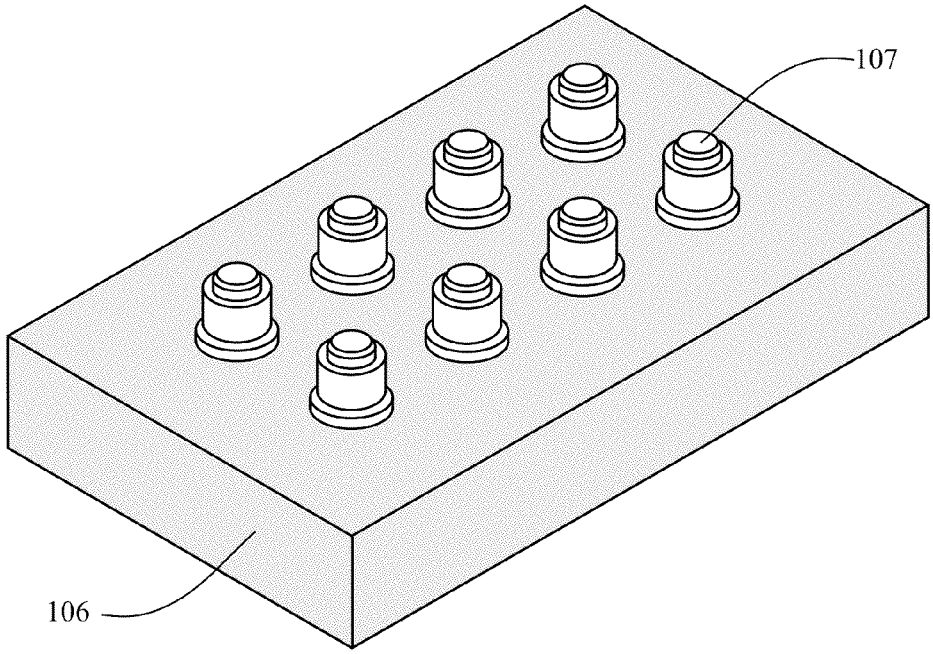
FIG. 1 is a perspective view of a substrate with structural fasteners.

FIG. 1 is a perspective view of a substrate 106 with structural fasteners 107.

Figure 2:
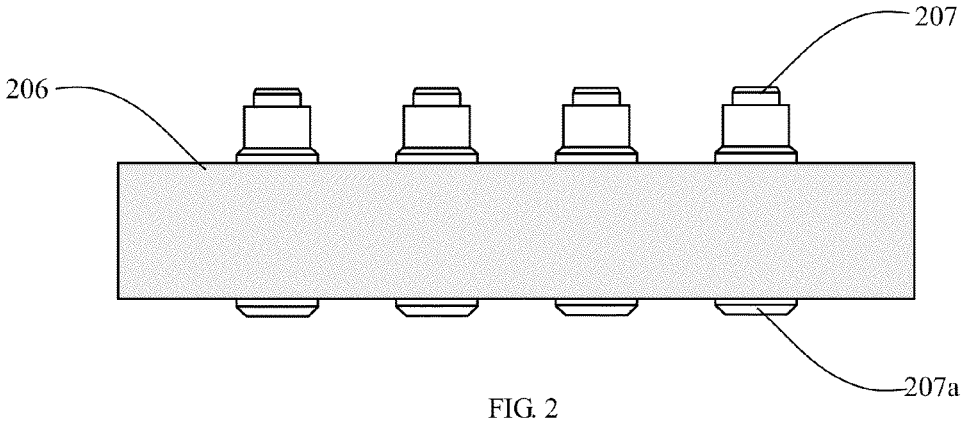
FIG. 2 is a side view of a substrate with structural fasteners.

FIG. 2 is a side view of a substrate 206 with structural fasteners 207 that extend through 207*a* the substrate 206.

Figure 3:
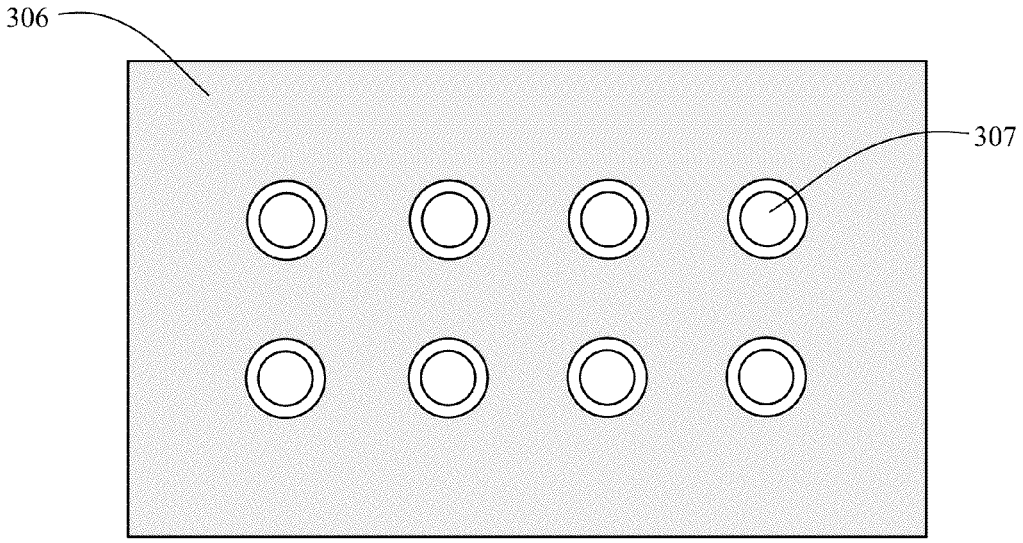
FIG. 3 is a bottom view of a substrate with structural fasteners.

FIG. 3 is a bottom view of a substrate 306 with structural fasteners 307.

Figure 4:
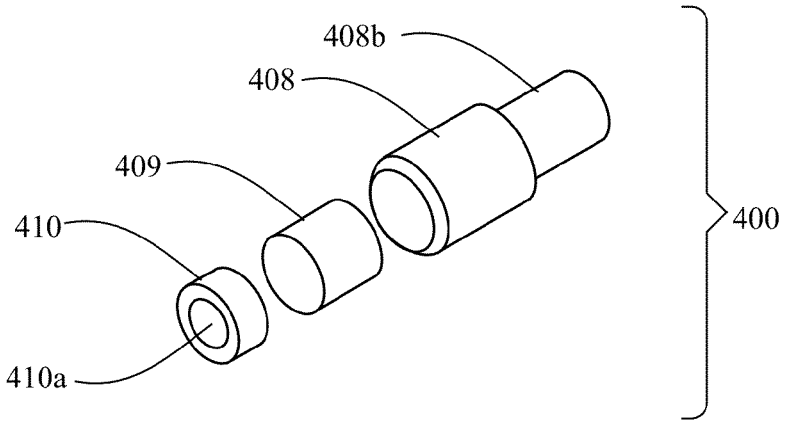
FIG. 4 is an exploded view of a fluid applicator.

FIG. 4 is an exploded view of a fluid applicator 400 comprising a hollow base 408, neck 408*b*, first porous material insert 409, and second porous material insert 410. The second porous material insert 410 has an aperture or opening 410*a* which may extend partly or completely through the length of the second porous material insert 410.

The neck 408*b* connected to the hollow base 408 is constructed out of the same material as the hollow base 408. The neck 408*b* is integral with the base 408. The fluid applicator 400 is connected to a source of fluid (not shown) and contains a passage for the flow of fluid to the hollow base from a source.

Figure 4A:
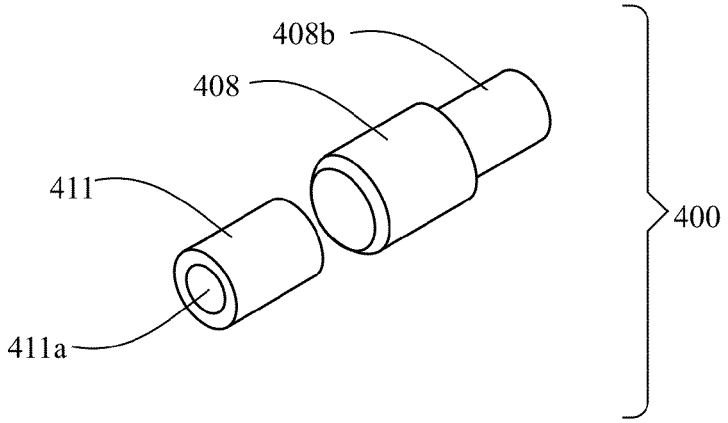
FIG. 4A is an alternate exploded view of a fluid applicator.

FIG. 4A is an exploded view of a fluid applicator 400 comprising a hollow base 408, neck 408*b*, a single porous material insert 411, and an aperture or opening 411*a* that extends partially through the length of the second porous material insert 411.

Figure 5:
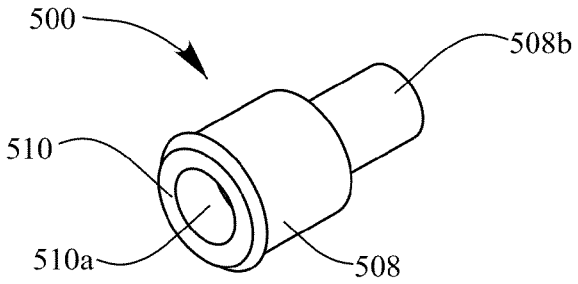
FIG. 5 is a perspective view of a fluid applicator.

FIG. 5 is a perspective view of a fluid applicator 500 comprising a base 508, neck 508*b*, first porous material insert (not shown), and second porous material insert 510. The second porous material insert 510 has an aperture or opening 510*a* which extends through the entire length of the second porous material insert 510.

Figure 6:
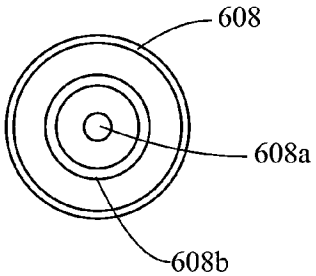
FIG. 6 is an end view of a fluid applicator.

FIG. 6 is an end view of a fluid applicator shown in FIG. 5. Illustrated are the base 608, neck 608*b*, and base aperture or opening 608*a*.

Figure 7A:
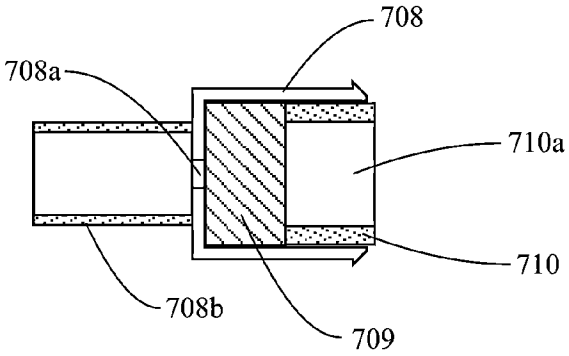
FIG. 7A is a section 7A-7A view of the fluid applicator of FIG. 7.
Figure 7:
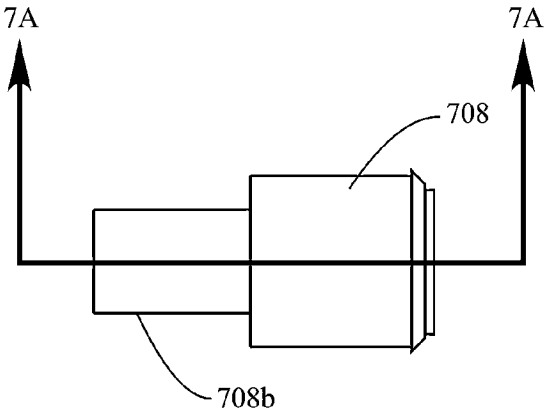
FIG. 7 is an either side view of a fluid applicator.

FIG. 7 is an either side view of a fluid applicator shown in FIG. 5. Illustrated are the base 708 and neck 708*b*.

FIG. 7A is a section 7A-7A view of a fluid applicator of FIG. 7.

Figure 8:
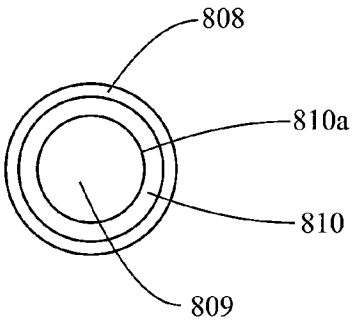
FIG. 8 is an end view of a fluid applicator.

FIG. 8 is an end view of a fluid applicator shown in FIG. 5. Illustrated are the base 808, first porous material 809, second porous material 810, and porous material aperture or opening 810*a*.

Figure 9:
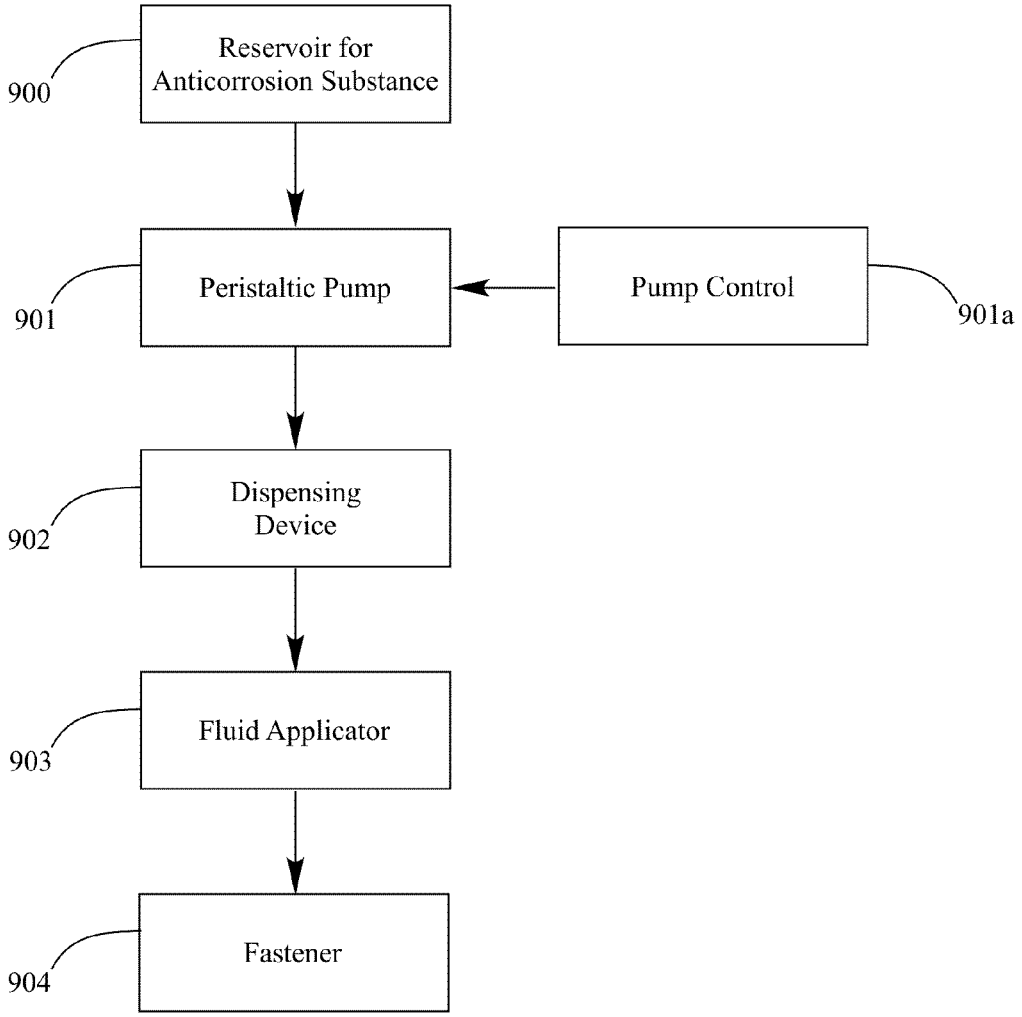
FIG. 9 is a block diagram of the fluid applicator method.

FIG. 9 is a block diagram of the overall method for applying a fluid such as an anticorrosion substance to an object such as a structural fastener. An anticorrosion substance is placed into the reservoir 900. The substance is pumped to the dispensing device 902 by a peristaltic pump 901 with pump controls 901*a*. The fluid applicator 903 is mounted on or in the dispensing device 902. The controls 901*a* and pump 901 controllably meter and flow the substance to the dispensing device 902 and fluid applicator 903. The fluid applicator 903 applies the anticorrosion substance uniformly to the fastener 904.

The fastener can be of any geometric shape or dimension including any diameter or length. Types of fasteners include aerospace bolts, rivets, screws, and studs which protrude partially or completely through a substrate such as a section of a wing, external fuselage, or internal structural support of an aircraft.

In one embodiment, the anticorrosion coating is applied to the threaded section of a threaded lockbolt. In another embodiment, the lockbolt has a collar that is coated. In another embodiment, the lockbolt has a protruding round or flat head that is coated.

The fluid applicator has a female aperture of porous material that fits over the male protrusion such as a fastener so that the porous material covers and is in contact with the fastener. The anticorrosion substance flows into the hollow body and into the porous material and is dispensed as a uniform coating on the fastener.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined by the appended claims.

The invention claimed is:

1. An applicator for applying an anticorrosion substance to a surface protrusion, said applicator comprising a hollow body having an elongated axis with opposing ends and an opening at each of the opposing ends, a porous material positioned inside said hollow body along the elongated axis, said material containing an aperture at one end and opening of the hollow body, said aperture having a predetermined geometric shape and an aperture depth equal to or greater than the height of the protrusion so as to allow the porous material to cover the protrusion such that the anticorrosion substance flowing from the porous material is controllably and uniformly applied to the protrusion.

2. The invention of claim 1 wherein the geometric shape of the aperture is the same geometric shape as the protrusion.

3. The invention of claim 1 wherein the porous material comprises two or more abutting sections.

4. The invention of claim 3 wherein each section is made of the same porous material.

5. The invention of claim 1 wherein the porous material comprises two abutting sections, each section being made of a porous material of the same composition.

6. The invention of claim 1 wherein the porous material comprises two abutting sections, each section being made of a porous material of a different composition.

7. The invention of claim 1 wherein the protrusion is a structural fastener.

8. The invention of claim 1 wherein the fluid is a corrosion resistant conversion composition.

9. An applicator for applying an anticorrosion fluid to a surface protrusion, said applicator comprising a hollow body having an elongated axis with opposing ends and an opening at each of the opposing ends, a porous material is positioned inside the hollow body along the elongated axis, the porous material containing an aperture at one end and opening of the hollow body, said porous material aperture having a predetermined depth and diameter so as to match the height and the geometric shape of the protrusion and cover the surface protrusion, the aperture depth being equal to or greater than the height of the protrusion such that the anticorrosion fluid flowing from the porous material is controllably and uniformly applied to the surface protrusion.

10. The invention of claim 9 wherein the porous material comprises two or more abutting sections.

11. The invention of claim 10 wherein each section is made of the same porous material.

12. The invention of claim 9 wherein the protrusion is a structural fastener.

13. The invention of claim 9 wherein the fluid is a corrosion resistant conversion composition.

14. An applicator for applying an anticorrosion fluid to a surface protrusion, said applicator comprising a hollow body having an elongated axis with opposing ends and an opening at each opposing end, a porous material positioned inside the hollow body along the elongated axis, said porous material comprising two separate sections, one section of the porous material containing an aperture at one opening of the hollow body, said aperture having a predetermined geometric shape and an aperture depth equal to or greater than the height of the protrusion to allow the porous material to cover a surface protrusion such that the anticorrosion fluid flowing from the porous material is controllably and uniformly applied to the protrusion.

15. The invention of claim 14 wherein the protrusion is a structural fastener.

16. The invention of claim 14 wherein the fluid is a corrosion resistant conversion composition.

* * * * *